US008602043B2

(12) United States Patent
Kaiser

(10) Patent No.: US 8,602,043 B2
(45) Date of Patent: Dec. 10, 2013

(54) BOAT STORAGE CANOPY APPARATUS FOR BOATS WITH WAKE BOARD TOWERS

(76) Inventor: Daniel J. Kaiser, Bartlett, IL (US)

( * ) Notice: Subject to any disclaimer, the term of this patent is extended or adjusted under 35 U.S.C. 154(b) by 17 days.

(21) Appl. No.: 13/095,057

(22) Filed: Apr. 27, 2011

(65) Prior Publication Data

US 2011/0290292 A1 Dec. 1, 2011

Related U.S. Application Data

(63) Continuation-in-part of application No. 29/362,689, filed on May 28, 2010, now Pat. No. Des. 637,134.

(51) Int. Cl.
*E04H 15/34* (2006.01)

(52) U.S. Cl.
USPC ..... 135/122; 135/906

(58) Field of Classification Search
USPC ..... 135/122, 97, 906, 121; 114/361
See application file for complete search history.

(56) References Cited

U.S. PATENT DOCUMENTS

| | | | | |
|---|---|---|---|---|
| 3,083,540 | A * | 4/1963 | Smith | 405/3 |
| 4,019,212 | A * | 4/1977 | Downer | 114/361 |
| 4,683,901 | A * | 8/1987 | Mitchell | 135/97 |
| 5,419,273 | A * | 5/1995 | Cutler | 114/263 |
| 5,573,026 | A * | 11/1996 | Griffith | 135/122 |
| 6,102,059 | A * | 8/2000 | Miller | 135/87 |
| 6,786,171 | B1 * | 9/2004 | Elbers | 114/361 |
| 6,895,886 | B1 * | 5/2005 | Pawlowski et al. | 114/361 |
| 7,467,784 | B2 * | 12/2008 | Turner | 254/394 |
| 2005/0252542 | A1 * | 11/2005 | Basta | 135/156 |
| 2007/0295379 | A1 * | 12/2007 | Basta | 135/122 |
| 2009/0038528 | A1 * | 2/2009 | Van Berkel | 114/361 |

OTHER PUBLICATIONS

Daniel J. Kaiser; 3 pages of Boat Storage Canopy Apparatus pictures.

* cited by examiner

*Primary Examiner* — Noah Chandler Hawk
(74) *Attorney, Agent, or Firm* — Ladas & Parry LLP

(57) ABSTRACT

A boat storage canopy fitted to a boat storage lift has an entry portion, raised center portion and shore side portion with downwardly depending curtains on first and second sides and the shore side end with a hinged curtain at the entry end.

6 Claims, 6 Drawing Sheets

BOAT STORAGE CANOPY APPARATUS FOR BOATS WITH WAKE BOARD TOWERS

CLAIM OF PRIORITY

This application claims priority based upon U.S. patent application Ser. No. 29-362,689 filed May 28, 2010 and entitled Boat Storage Canopy.

BACKGROUND OF THE INVENTION

1. Field of the Invention

The invention is a boat storage canopy and apparatus adapted to lift and provide dry storage for a boat having a wakeboard tower or other elevated midships structure.

2. Description of Related Art

Boat houses and canopies raised above the water surface are known for the weather protection of a boat and permit a floating boat to enter and exit. Boat lifts, hoists and the like are known and permit a boat to be lifted from the water's surface for dry storage, maintenance and the like. Lifts are known to be used in boathouses and to have canopies fitted or otherwise used in conjunction with mooring or storage structures.

While various flat, peaked or curved roofs, when looking at a transverse section, are known, substantially all the length is of uniform height having a horizontal ridge or equivalent.

Horizontal ridge canopies or roofs when used to receive a boat having an elevated superstructure such as a wakeboard tower, flying bridge, radar arch or the like have to be mounted with a vertical dimension adequate to permit ingress and egress. Traditionally, boat canopies have been either flat topped or barn roof type of structures that either do not provide sufficient protection because the boat cannot be raised high enough with a wakeboard tower in place or are structurally demanding, provide high windage and are aesthetically unpleasing. Simply elevating the flat canopy or roof will either leave substantial portions of the boat exposed to weather, such as driving rain, or will require extensively downwardly extending walls or curtains thereby requiring additional structure with incumbent additional expense, complexity and windage.

SUMMARY OF THE INVENTION

A wakeboard tower canopy enables wakeboard boats which contain wakeboard towers of various height that protrude above the gunwale, sheer, and/or windshield of the wakeboard boat to gain protection against the elements. By constructing a special frame that incorporates a drive-through curtain system and also a peak in the canopy structure itself, the wakeboard boat is allowed to pull in to the normal lift with enough clearance for the tower from the canopy frame and then once the boat pulls into the lift far enough, it can then be raised to the full protective height underneath the confines of the peaked portion of the roof canopy structure.

A boat canopy adapted to receive a boat with an elevated structure can be mounted above a boat lift and has generally three portions, an entry portion a raised center portion and a front end portion. The entry and shore side portion are preferably the same height with the center portion substantially vertically displaced therefrom. Sidewalls or curtains extend down from a canopy edge frame. An entry curtain permits hinged movement inwardly and outwardly depending upon the direction of movement entering or exiting of the boat. The boat can be raised with its wakeboard tower aligned with the raised center portion. In this manner the boat can be protected from the weather but the overall structure having reduced height windage and materials.

DETAILED DESCRIPTION OF THE PREFERRED EMBODIMENT

Figure 1:
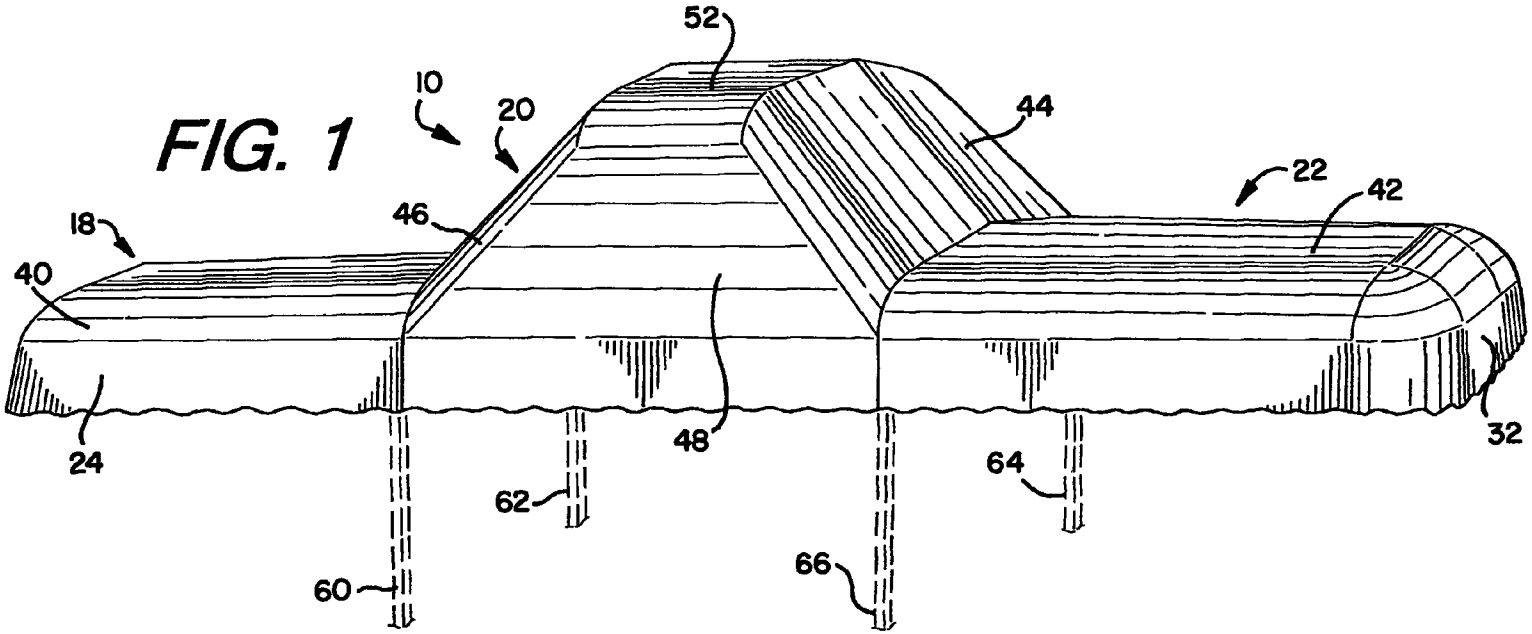
FIG. 1 is a perspective view of the boat storage canopy which is subject of the present application.
Figure 2:
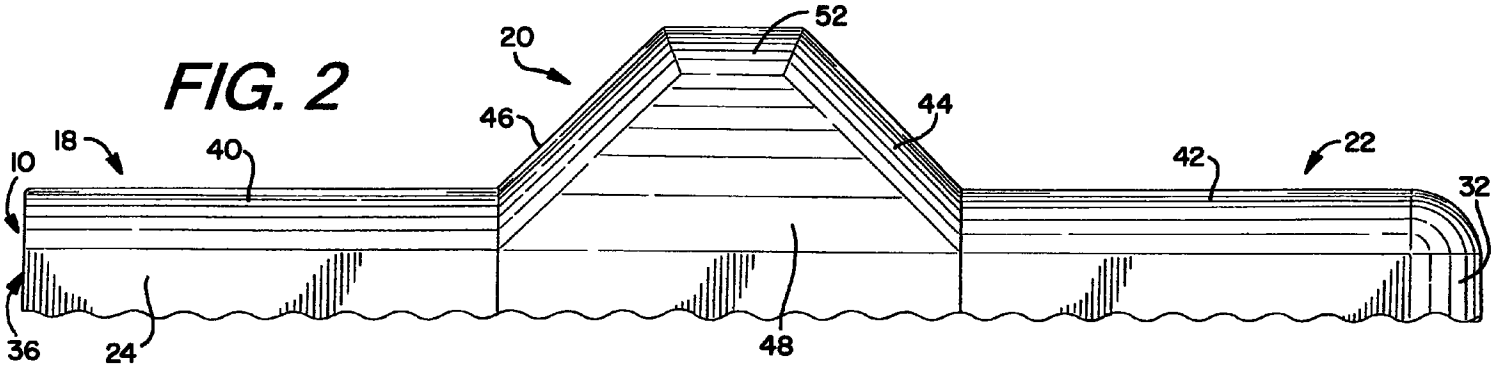
FIG. 2 is right side elevational view thereof, the left side elevational view being a mirror image thereof.
Figure 8:
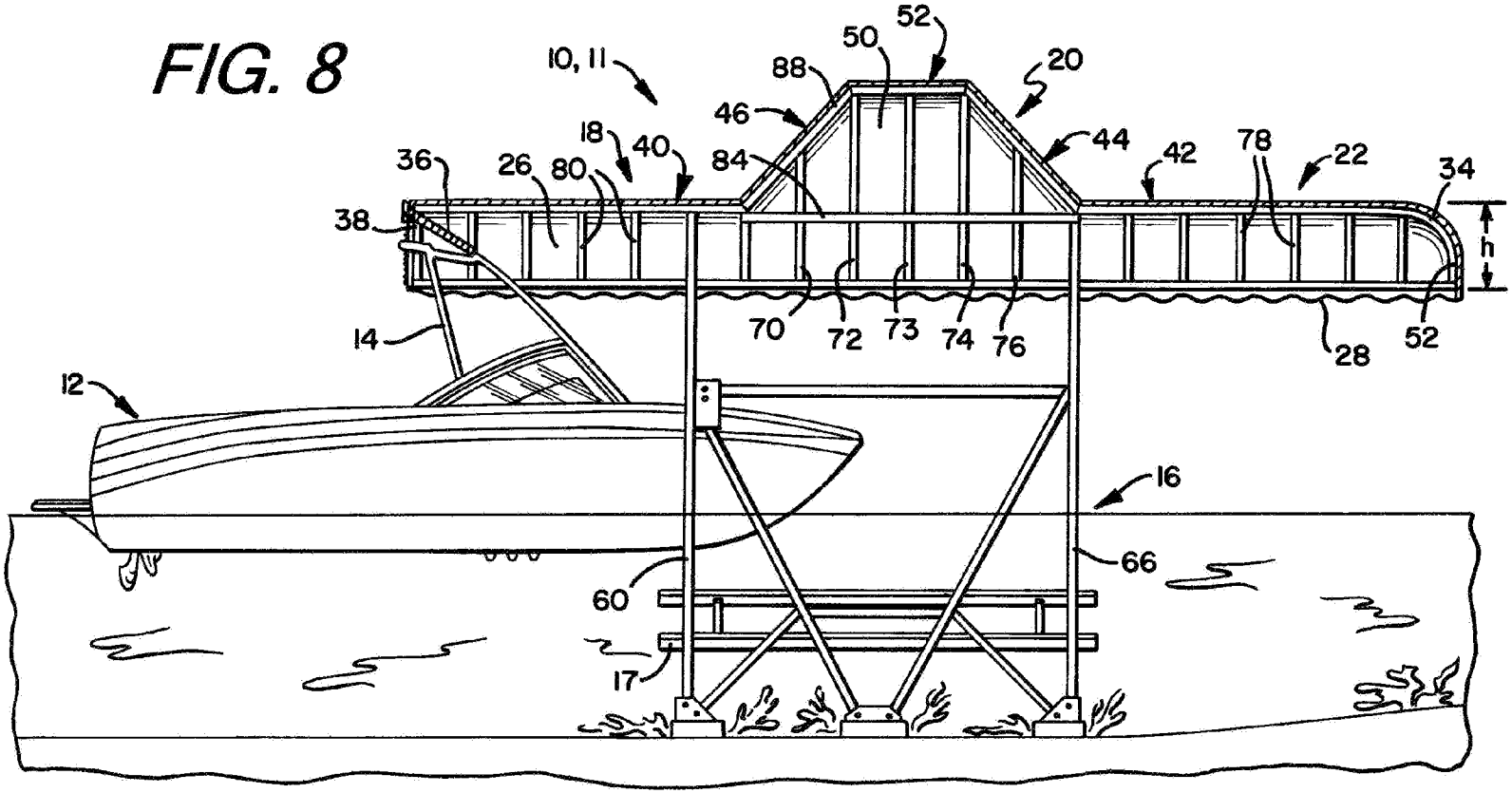
FIG. 8 is a sectional view of the canopy with a boat entering.
Figure 9:
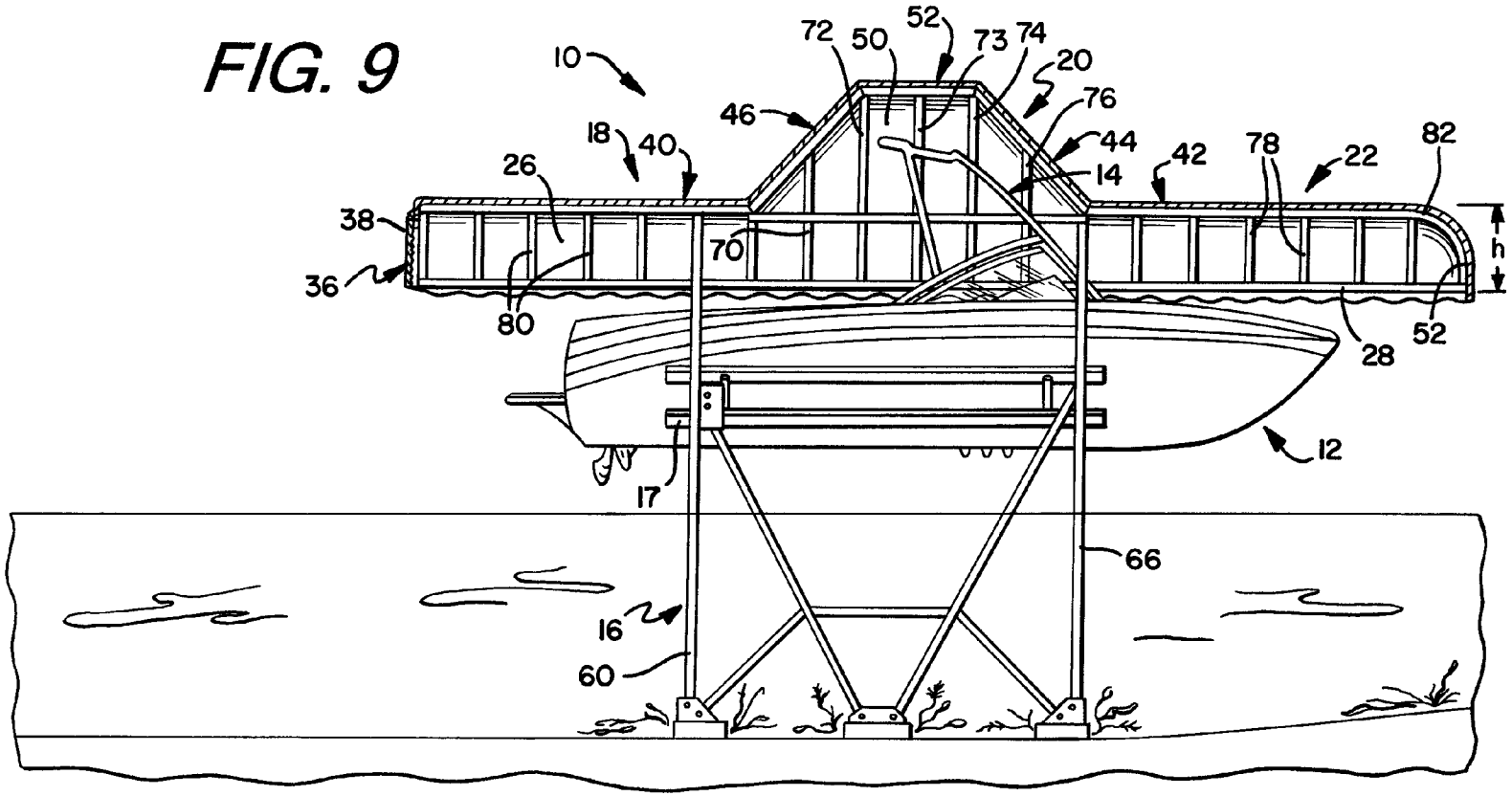
FIG. 9 is a sectional view of the boat's storage canopy with a boat in the raised storage position.

Referring now to FIGS. 1 and 2, a boat canopy 10 is adapted to receive a boat 12 having an elevated structure 14 (FIGS. 8 and 9), such as a wakeboard tower. The canopy 10 can be fixed to a canopy frame 11 (FIG. 6) and mounted above a boat lift 16 (FIGS. 8 and 9). The canopy 10 and canopy frame 11 are formed and arranged to have three portions: an entry portion 18, a raised center portion 20 and a front end portion 22. The term "front end portion" 22 is defined in this specification to be relative to the canopy 10, only. The entry 18 and front end 22 portions are preferably the same height with the center portion 20 substantially vertically displaced therefrom. Perimetrical downwardly depending sidewalls or curtains 24, 26 extend from the canopy roofs 40, 52, and 42 of the entry portion 18, raised center portion 20, and front end portion 22.

Figure 4:
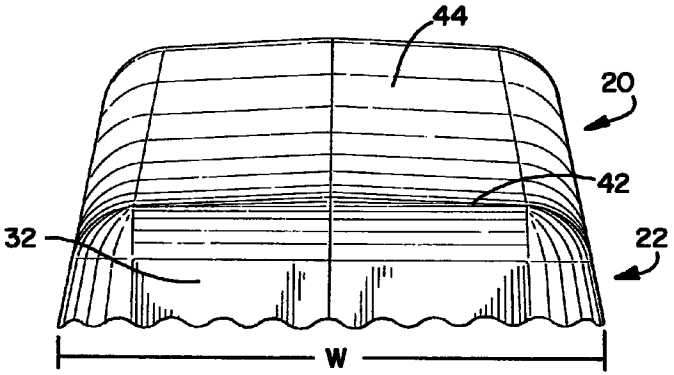
FIG. 4 is a rear elevational view thereof.
Figure 3:
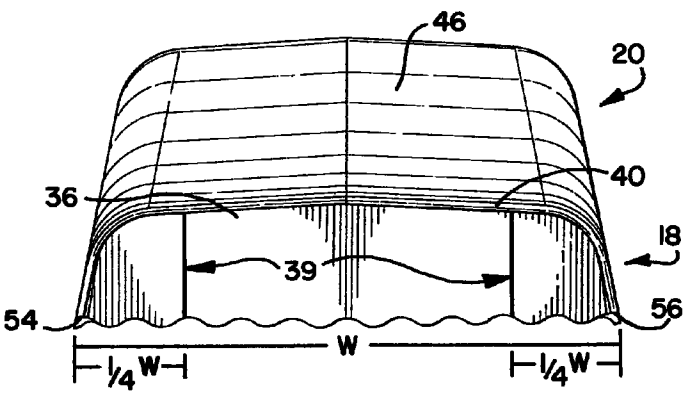
FIG. 3 is a front elevational view thereof.

Referring now to FIGS. 3 and 4, front end curtain 32 extends downwardly from the roof 42 of the front end portion 22 and front end frame member 34 and is preferably affixed at its corners to the side curtains 24, 26. An entry curtain 36 extends downwardly from an entry frame member 38, having a length 'w,' and permits hinged movement inwardly and outwardly depending upon the direction of movement of the boat 12 while entering or exiting. The canopy frame 11, as further described below, leaves an entrance to the canopy at the entry portion 18 generally open, which allows the boat 12 and elevated structure 14 to pass under the entry portion roof 40. In a preferred embodiment, curtains 24, 26, 32 and frame members 28, 30, 34 drop down approximately 18" from the roofs 40, 42 of the entry portion 18 and front end portion 22.

The entry curtain 36 may also have one or more open seams 39 to allow for hinged movement of the entry curtain 36. In the preferred embodiment, entry curtain 36 is formed and arranged to have the open seams 39 at approximately ¼ of the distance 'w' from each entry frame end 37 so as to enable the boat 12 and elevated structure 14 to pull through the entry curtain 36 upon either entering or departing the canopy 10 and boat lift 16.

The horizontal roof 40 of the entry portion 18 typically protects the aft portion of the boat 12. The horizontal roof 42 of the front end portion 22 typically protects the forward portion of the boat 12.

Figure 5:
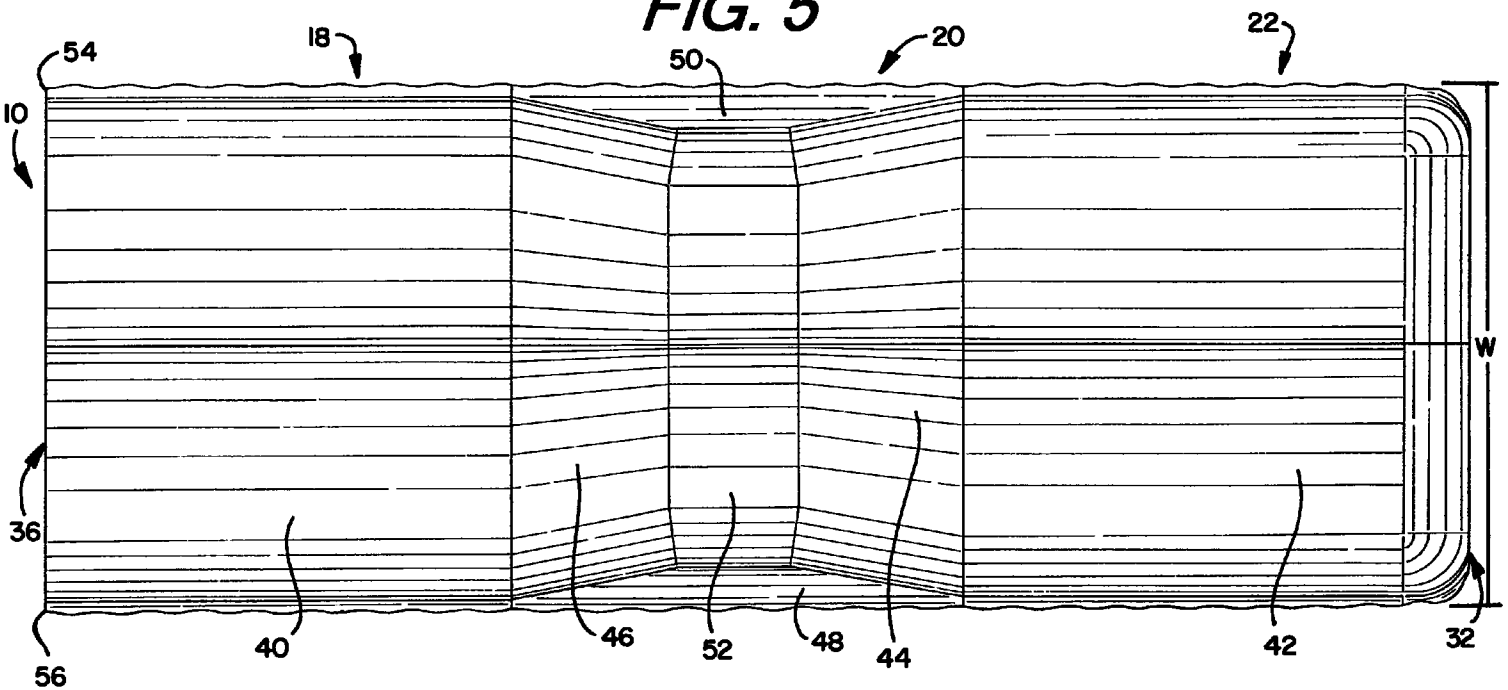
FIG. 5 is a top plan view thereof.

Referring now to FIG. 5, the raised center portion 20 has an upwardly projecting shore side panel 44, upwardly projecting entry side panel 46, and side panels 48, 50. All the panels 44, 46, 48, 50 mate with a roof panel 52 to form a continuous weather-tight surface. Additionally, the roofs 40, 42 are similarly continuously connected to the raised center portion 20 and the curtains 24, 26, 32 are formed and arranged to provide a continuous weather-tight surface. The entry curtain 36 is able to open and close, as described below.

The typical ski/wakeboard boat lift 16 sits in the water on four support posts 60, 62, 64, 66 and consists of a cradle that is lowered to a point in the water beneath the boat 12 so that the boat 12 can pull on and off the lift 16 when afloat. A carriage or mechanism 17 of the lift 16 is raised or lowered in order to either disembark or store the boat 12 depending on the user's action.

Upon entry of the boat 12 into the canopy 10 and temporarily mooring in position for operation of the lift 16, the seams 39 of the end curtain 36 can be closed using fasteners (not shown). Using the lift 16, the boat 12 can be raised with its wakeboard tower 14 aligned with the raised center portion 20. Upon confirmation of alignment, the lift 16 can be engaged and the entire boat 12 lifted out of the water so that the boat's gunwale is raised proximate the downwardly depending curtains 24, 26, 32 to provide substantial weather protection.

Shown in FIG. 2, lift 16 is preferably mounted on posts 60, 62, 64, 66, which posts 60, 62, 64, 66, also support canopy 10. It will be noted that the spacing of posts 60, 62, 64, 66 is such that they are generally located proximate the intersection between the center portion 20 and entry portion 18 at the entry end, and the intersection between center portion 20 and front end portion 22. In this manner, entry portion 18 and front end portion 22 are supported in cantilevered fashion.

Figure 6:
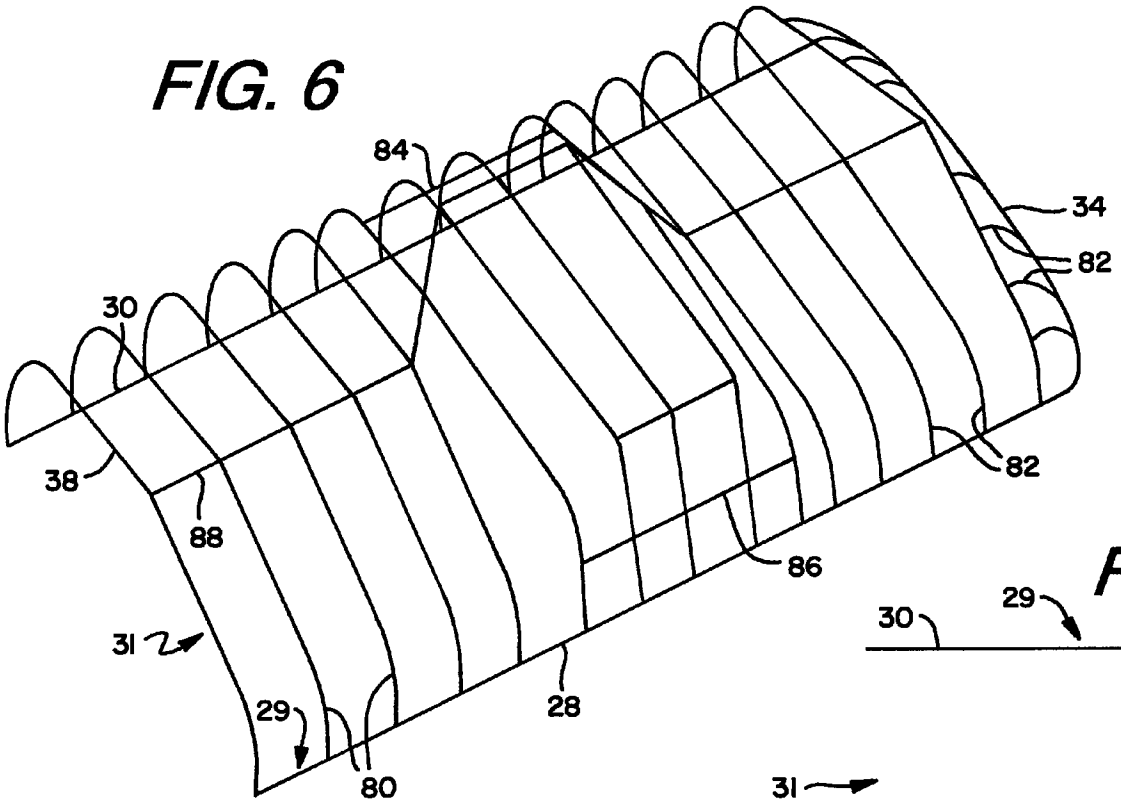
FIG. 6 is a perspective view of the boat storage canopy frame.
Figure 7:
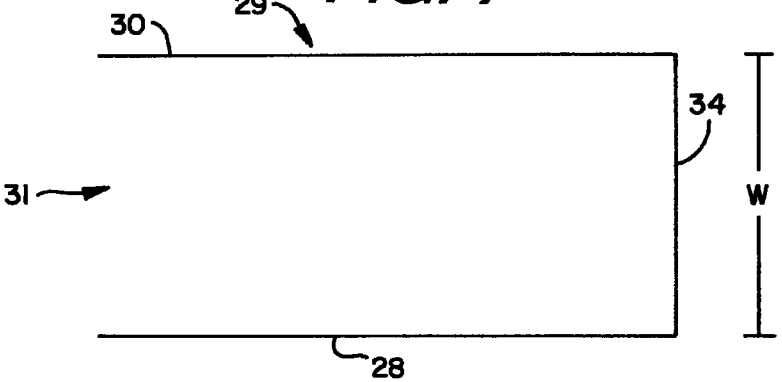
FIG. 7 is a top plan view of a U-shaped member of the canopy frame.

Referring now to FIGS. 6 and 7, structurally, edge frames 28, 30 and end frame members 34, 38 define the perimeter of canopy frame 11, with center frame members 70, 72, 74, 76 defining center portion 20 and supporting panels 44, 46, 48, 50 and 52. In FIG. 7, edge frames 28 and 30 join front end frame member 34 to create a U-shaped frame member 29. Entry frame member 38 is a transverse member extending over the open end 31 of the U-shaped frame member 29. As shown, elevated center frame members 70 and 76 are midlevel frame members and have a vertical height between the highest center frame members 72, 73, 74 and the front end portion members 78 and entry portion members 80. Front end support members 82 join a front end portion member 78 and front end frame member 34.

Front end portion members 78, entry portion members 80, and center frame members 70, 72, 73, 74, and 76 are transverse members joining edge frames 28 and 30 to create a unitary structure supported by posts 60, 62, 64, 66. Generally, the transverse members 78, 80 of the front end portion 22 and the entry portion 18 have a height 'h' above the U-shaped frame member 29. In a preferred embodiment, center frame members 70, 72, 73, 74, and 76 are centered on the U-shaped frame 29 between the front end frame member 34 and the entry frame member 38. Center frame support members 84, 86 provide additional support to center frame members 70, 72, 73, 74, and 76. Parallel frame member 88 begins at entry frame member 38, and joins each transverse member 78, 80, 70, 72, 73, 74, and 76 and ends at front end frame member 34.

Referring to FIGS. 8 and 9, the canopy 10 is formed and arranged so that when the boat 12 is afloat the highest point of the wakeboard tower 14 will clear the lowest point on the entry frame member 38. When storing the boat 12 with wakeboard tower 14, the operator will drive the boat 12 into the boat lift 16 with the highest point of the wakeboard tower 14 clearing the lowest point of the entry frame member 38 work and the tower pushing through the entry curtain 36. Alternatively, the entry curtain 36 can be arranged to rest on the entry portion roof 40. The operator then positions the boat 12 in the lift 16 in its normal position so that the wakeboard tower 14 is substantially centered in the peak of the wakeboard tower canopy in the center portion 20. The operator then activates the lift 16 to raise the carriage 17 and boat 12 to a height sufficient to have the boat 12 clear out of the water and allow the canopy 10 to provide adequate protection from the elements (FIG. 9).

From the stored position, the operator will lower the cradle of the lift 16 and boat 12 until the boat 12 is just floating and then back out the boat 12 using reverse thrust, allowing the wakeboard tower 14 to clear the lowest point of the entry frame member 38 and pass through the curtain 36 overhanging the entrance.

In this manner the boat 12 can be protected from the weather but the overall structure having reduced height windage and materials.

The forgoing is a preferred embodiment however it will be recognized that variations consistent with this disclosure, arrangement of boat structures and maneuvering such as backing into a mooring can be accommodated.

The invention claimed is:

1. A boat lift canopy assembly comprising:

a canopy frame comprising a U-shaped frame member and transverse members joining each side of the U-shaped member, and wherein a boat canopy covers the canopy frame;

an entry portion located on an open end of the U-shaped frame member, wherein the entry portion comprises at least an entry curtain from the boat canopy, and wherein the entry curtain opens up to a predetermined height upon entry or egress of a boat;

a raised center portion; and a front end portion located on a closed end of the U-shaped frame member;

wherein, the central raised portion is formed from at least one elevated transverse frame member located between the entry portion and the front end portion, and wherein a plurality of support posts are joined between the canopy frame and a boat lift, wherein a length of the boat lift is less than two-thirds of a length of the canopy frame, and wherein the boat lift is underneath the canopy frame, and wherein the boat lift is positioned between the first outer edge of the entry curtain of the entry portion and the closed end of the U-shaped frame member of the front end portion.

2. The boat lift canopy assembly of claim 1, wherein the at least one elevated frame member comprises:

at least two midlevel frame members, one of which is located adjacent the entry portion, the other being adjacent the front end portion, and at least one highest frame member located between the midlevel frame members.

3. The boat lift canopy assembly of claim 2, wherein there are three highest frame members located between the midlevel frame members.

4. The boat lift canopy assembly of claim 1, wherein the transverse members located over the entry portion and the front end portion are arched in such a way as to have a predetermined height above the U-shaped frame.

5. The boat lift canopy assembly of claim 1, wherein the raised center portion is substantially centered between a front end frame member and an entry frame member.

6. The boat lift canopy assembly of claim 1, wherein the canopy frame is mounted to the boat lift by the plurality of support posts.

* * * * *